US008995859B2

(12) United States Patent
Ogura

(10) Patent No.: US 8,995,859 B2
(45) Date of Patent: Mar. 31, 2015

(54) IMAGE FORMING APPARATUS

(75) Inventor: Ryota Ogura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 13/324,203

(22) Filed: Dec. 13, 2011

(65) Prior Publication Data

US 2012/0155905 A1 Jun. 21, 2012

(30) Foreign Application Priority Data

Dec. 15, 2010 (JP) ..... 2010-279299

(51) Int. Cl.
*G03G 15/20* (2006.01)
*G03G 15/00* (2006.01)
*G03G 21/14* (2006.01)

(52) U.S. Cl.
CPC ..... *G03G 15/5004* (2013.01); *G03G 21/14* (2013.01); *G03G 15/205* (2013.01); *G03G 15/2039* (2013.01); *G03G 15/2078* (2013.01); *G03G 2215/00949* (2013.01); *G03G 2215/2045* (2013.01)
USPC ..... 399/69; 399/68

(58) Field of Classification Search
CPC ..... G03G 15/2039; G03G 15/2078; G03G 15/5004; G03G 21/14
USPC ..... 399/68, 69, 400
See application file for complete search history.

(56) References Cited

U.S. PATENT DOCUMENTS 5,904,871 A * 5/1999 Sakai et al. ..... 219/216
5,994,671 A * 11/1999 Suzuki et al. ..... 219/216
6,853,818 B2 2/2005 Nishida
2003/0072581 A1 4/2003 Nishida
2006/0204266 A1 * 9/2006 Watabe ..... 399/69

FOREIGN PATENT DOCUMENTS

CN 1412626 A 4/2003
JP 5-333726 A 12/1993
JP 2003-123941 A 4/2003

OTHER PUBLICATIONS

Chinese Office Action dated Jan. 3, 2014, issued in counterpart Chinese Application No. 201110409651.2, and English-language translation thereof.
Chinese Office Action dated Jul. 18, 2014, issued in counterpart Chinese Application No. 201110409651.2, and English-language translation thereof.

* cited by examiner

*Primary Examiner* — Benjamin Schmitt
(74) *Attorney, Agent, or Firm* — Fitzpatrick, Cella, Harper & Scinto

(57) ABSTRACT

An image forming apparatus includes a fixing portion for fixing an unfixed image formed on a sheet. The fixing portion includes an endless belt, a heater contacting the inner surface of the belt and including first and second heat generators, and a pressor forming a fixing nip with the heater for nipping and feeding the sheet. The apparatus also includes a controller for controlling electric power supplied to the first and second heat generators. The controller controls the first and second heat generators independently from each other. The apparatus sets a plurality of feeding speeds of the sheet, and the controller changes the difference between the times at which electric power is supplied to the first and second heat generators in accordance with the sheet feeding speed.

15 Claims, 16 Drawing Sheets

(a)

(b)

(a) HTR 203

| | | | | | | | | |
|---|---|---|---|---|---|---|---|---|
| 0% | 0 | 0 | 0 | 0 | 0 | 0 | 0 | 0 |
| ∫ | | | | | | | | |
| 45% | 100 | 0 | 45 | 45 | 0 | 100 | 45 | 45 |
| 47.5% | 100 | 0 | 47.5 | 47.5 | 0 | 100 | 47.5 | 47.5 |
| 50% | 100 | 0 | 50 | 50 | 0 | 100 | 50 | 50 |
| ∫ | | | | | | | | |
| 100% | 100 | 100 | 100 | 100 | 100 | 100 | 100 | 100 |

(b) HTR 204

| | | | | | | | | |
|---|---|---|---|---|---|---|---|---|
| 0% | 0 | 0 | 0 | 0 | 0 | 0 | 0 | 0 |
| ∫ | | | | | | | | |
| 45% | 100 | 0 | 45 | 45 | 0 | 100 | 45 | 45 |
| 47.5% | 100 | 0 | 47.5 | 47.5 | 0 | 100 | 47.5 | 47.5 |
| 50% | 100 | 0 | 50 | 50 | 0 | 100 | 50 | 50 |
| ∫ | | | | | | | | |
| 100% | 100 | 100 | 100 | 100 | 100 | 100 | 100 | 100 |

FIG.7

(a) HTR 203

| | | | | | | | | | | | | |
|---|---|---|---|---|---|---|---|---|---|---|---|---|
| 0/12 | 0 | 0 | 0 | 0 | 0 | 0 | 0 | 0 | 0 | 0 | 0 | 0 |
| ⋮ | | | | | | | | | | | | |
| 4/12 | 100 | 100 | 0 | 0 | 0 | 0 | 0 | 0 | 100 | 100 | 0 | 0 |
| 6/12 | 100 | 100 | 0 | 0 | 100 | 100 | 0 | 0 | 100 | 100 | 0 | 0 |
| ⋮ | | | | | | | | | | | | |
| 12/12 | 100 | 100 | 100 | 100 | 100 | 100 | 100 | 100 | 100 | 100 | 100 | 100 |

(b) HTR 204

| | | | | | | | | | | | | |
|---|---|---|---|---|---|---|---|---|---|---|---|---|
| 0/12 | 0 | 0 | 0 | 0 | 0 | 0 | 0 | 0 | 0 | 0 | 0 | 0 |
| ⋮ | | | | | | | | | | | | |
| 4/12 | 100 | 100 | 0 | 0 | 0 | 0 | 0 | 0 | 100 | 100 | 0 | 0 |
| 6/12 | 100 | 100 | 0 | 0 | 100 | 100 | 0 | 0 | 100 | 100 | 0 | 0 |
| ⋮ | | | | | | | | | | | | |
| 12/12 | 100 | 100 | 100 | 100 | 100 | 100 | 100 | 100 | 100 | 100 | 100 | 100 |

FIG.12

IMAGE FORMING APPARATUS

FIELD OF THE INVENTION AND RELATED ART

The present invention relates to an image forming apparatus comprising a fixing device for fixing a toner image on a recording material.

A heat fixing device of a film heating type having a ceramic heater as a heat source is known in the field of an image forming apparatus such as a copying machine or a laser beam printer or the like. In some of such a heat fixing device, a heater includes a plurality of heat generating elements arrange in a feeding direction of the recording material, the heat generating elements being independently actuatable, in which the heat generating elements are supplied with electric power from an AC power source through a switching element to control the temperature of the heater at a desired heating temperature level. As for an electric power supply control system to the heat generating element, a phase control and a wave number control are known, and Japanese Laid-open Patent Application 2003-123941 proposes a control system one control period includes a plurality of half waves a part of which waves are controlled by phase, and the other of which are controlled by wave number. Such a control system combining the phase control and the wave number control is called hybrid control.

However, the conventional image forming apparatus has the following problems. In the above-described fixing device, the ON/OFF of the heat generating element are effected during the recording material is passing the heat generating element, and therefore, on the recording material, there are a region passing the energized heat generating element and a region passing the non-energized heat generating element. In other words, the recording material has a portion heated by the heat generating element and a portion not heated thereby. As a result, a density difference such as stripes appears on the fixed image, which is call fixing non-uniformity. Generally, in the wave number control or the hybrid control, the cyclic period of ON/OFF switching of the heat generating element is relatively long, and therefore, the fixing non-uniformity tends to be remarkable. In addition to the control system, a feeding speed of the recording material is influential to the conspicuousness of the fixing non-uniformity.

In the case that heat generating elements are arranged in the feeding direction of the recording material, a total heat quantity provided by the heat generating elements is influential to the fixing non-uniformity. For example, two heat generating elements are provided, when the recording material has a portion heated by both of the heat generating elements and a portion not heated by either of heat generating elements, a fixing non-uniformity appears. A darkness difference of the non-uniformity, an occurrence cyclic period or the like of the fixing non-uniformity are different depending on a distance between the heat generating elements, the feeding speed of the recording material and the control system.

Under the circumstances, it has been propose that in order to prevent the portion heated by the first heat generating element from being heated again, the portion not heated by the first heat generating element is heated by the other by determining a distance between the heat generating elements, by which a heat quantity applied to the recording material is uniform. For example, Japanese Laid-open Patent Application Hei 5-333726 discloses a method in which the clearance between the heat generating elements is determined for an optimum level reducing the fixing non-uniformity, from the AC power source frequency and the feeding speed of the recording material.

However, this can reduce the fixing non-uniformity when the printing is carried out in a single speed, but when the feeding speed is switched between different levels depending on kinds and sized or the like of the recording material, the fixing non-uniformity is unavoidable. In other words, in the case that the feeding speed of the recording material is switched, the difference between the maximum and minimum total heat quantities is large, with result that the fixing non-uniformity arises when the feeding speed is switched.

Accordingly, it is a principal object of the present invention to provide an image forming apparatus with which the fixing non-uniformity is suppressed so that high image quality can be provided even when a feeding speed of a recording material is switched.

According to an aspect of the present invention, there is provided an image forming apparatus comprising a fixing portion for fixing an unfixed image formed on a recording material thereon, said fixing portion including, an endless belt, a heater contacted to an inner surface of said endless belt, said heater including a first heat generating element and a second heat generating element provided downstream of said first heat generating element with respect to a feeding direction of the recording material, and a pressing member cooperative with said heater to form a fixing nip for nipping and feeding the recording material; a controller for controlling electric power to be supplied to said first heat generating element and said second heat generating element, said controller being capable of controlling said first heat generating element and said second heat generating element independently from each other, wherein said device is capable of setting a plurality of feeding speeds of the recording material, and said controller changes a difference of times at which the electric power supply to said first heat generating element and said second heat generating element, in accordance with the recording material feeding speed.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 shows a control pattern for a hybrid control in this embodiment.

FIG. 12 shows a control pattern for a hybrid control in the second embodiment.

DESCRIPTION OF THE PREFERRED EMBODIMENTS

First Embodiment

1-1. General Arrangement of Image Forming Apparatus

Figure 1:
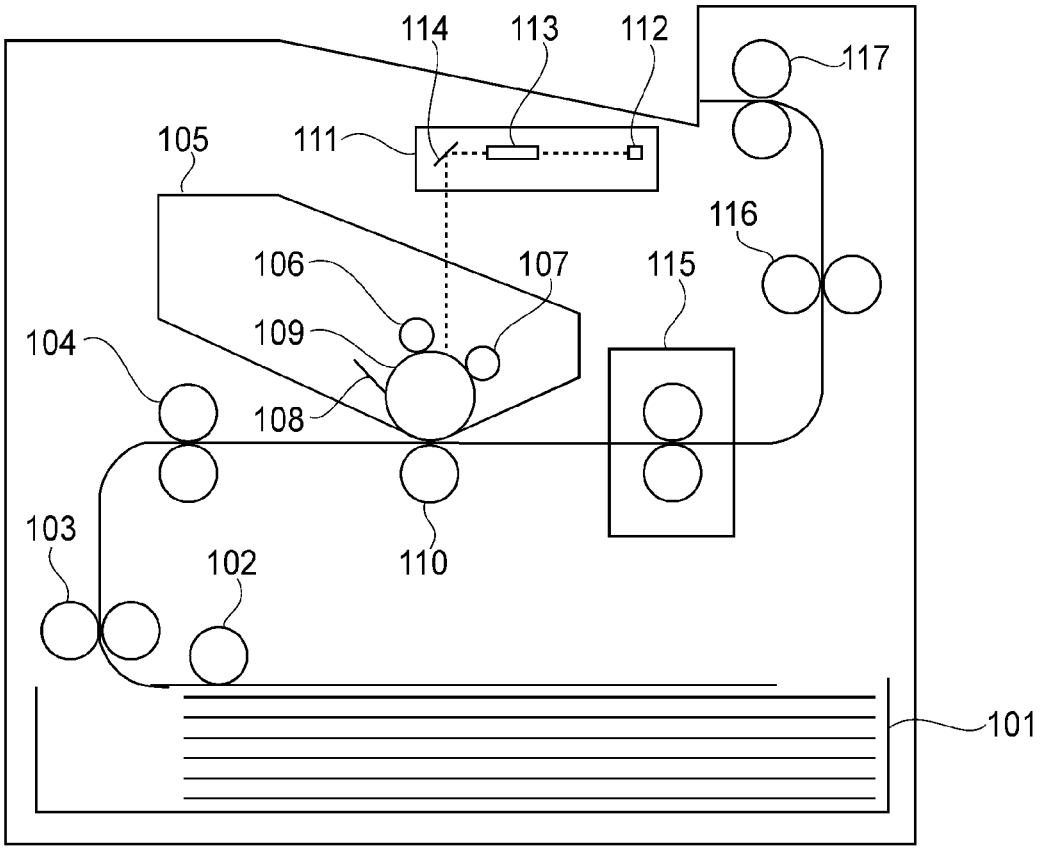
FIG. 1 is a schematic illustration of an image forming apparatus according to the present invention.

Referring to FIG. 1, a general arrangement of the image forming apparatus according to this embodiment will be described. The image forming apparatus is provided in a lower portion with a feeding cassette 101 capable of stacking a plurality of recording materials. When an image formation start signal is produced, the recording material stacked in the feeding cassette 101 is fed out one at a time by a pick-up roller 102, and is fed toward the registration roller 104 by feeding rollers 103. Then, the recording material is fed to the process cartridge 105 at predetermined timing by the registration roller 104

The process cartridge 105 comprises as a unit a charging roller 106, a developing roller 107, a cleaning member 108 and a photosensitive drum 109 which is an electrophotographic photosensitive member, and is detachably mountable to a main assembly of the device.

When an image is formed on the recording material, a surface of the photosensitive drum 109 is uniformly charged by the charging roller 106. Thereafter, the surface is exposed to light modulated in accordance with an image signal by a scanner unit 111 which is image exposure means. The scanner unit 111 comprises a laser diode 112 for emitting a laser beam, a rotatable polygonal mirror 113, and a reflection mirror 114. The laser beam emitted from the laser diode 112 scans in a main scan direction by the polygonal mirror 113 and the reflection mirror 114, and in a sub-scan direction by the rotation of the photosensitive drum 109. By this two-dimensional latent image is formed on the photosensitive drum 109.

The latent image formed on the photosensitive drum 109 is visualized into a toner image by toner supplied from the developing roller 107, and the toner image is transferred in the nip between a transfer roller 110 and the photosensitive drum 109, onto the recording material fed from the registration roller 104.

The recording material having received the toner image is fed to the fixing device 115 where the unfixed toner image on the recording material is heated and pressed in the fixing device 115 so that the toner image is fixed on the recording material. The recording material is discharged by an intermediary discharging roller 116 and the discharging roller 117 to an outside of the main assembly of the image forming apparatus, thus completing the series of printing operations.

1-2. General Structure of Fixing Device

Figure 4:
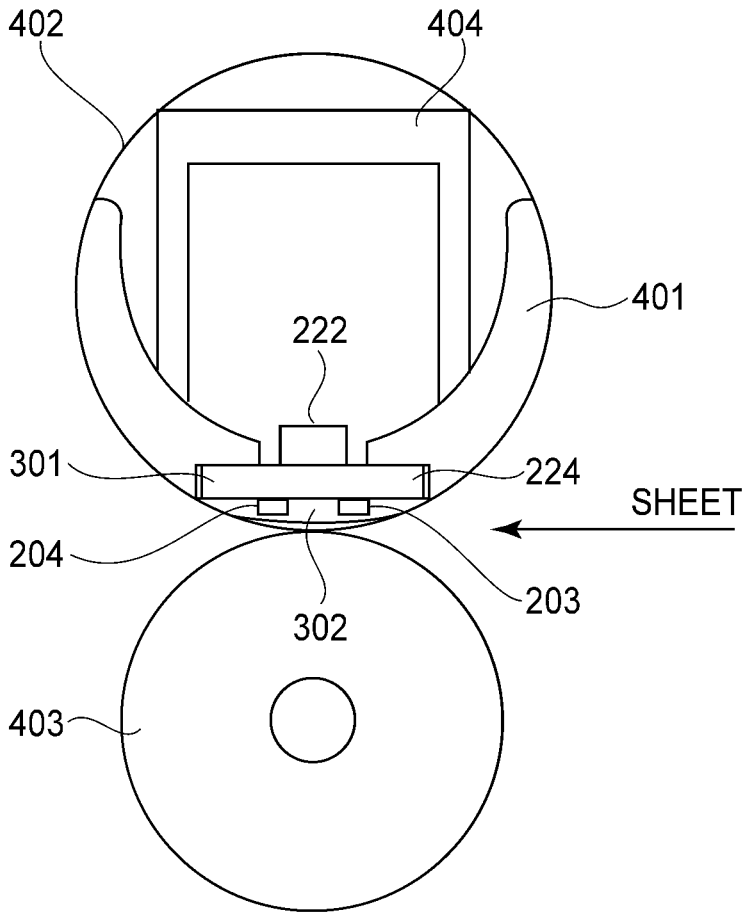
FIG. 4 is a schematic illustration of a fixing device in this embodiment.

Referring to FIG. 4, the general structure of the fixing device 115 will be described. FIG. 4 shows the general structure the fixing device 115. The fixing device 115 is a heating film type fixing device comprising a heat resistive heating sleeve 402 (endless belt) the having a flexibility, and an elastic pressing roller 403 (pressing member) press-contacted thereto. The heating sleeve 402 is telescoped around a sleeve guide 401 and is rotated by the elastic pressing roller 403, and the toner image on the recording material is heated and pressed, so that the toner image is fixed on the recording material. Inside of the sleeve guide 401, a stay 404 of a rigid member is provided.

Inside of the heating sleeve 402, a surface type heater 224 (heater) supported by a lower surface side of the sleeve guide 401 is provided. The ceramic surface type heater 224 is an elongated plate-like heater, and a longitudinal direction thereof is perpendicular in a rotational moving direction of the heating sleeve 402. The elastic pressing roller 403 is press-contacted to the heating sleeve 402 from an opposite of the ceramic surface type heater 224 toward the heater 224.

The ceramic surface type heater 224 comprises an insulation substrate 301 of ceramic material of SiC, ALN, Al2O3 or the like, a plurality of heat generating elements 203 (first heat generating element and second heat generating element) paste-printed onto insulation substrate 301, extending in the longitudinal direction thereof. The surfaces of the two heat generating elements are protected by protection layers of glass material.

On a side of the insulation substrate 301 opposite from the heat generating elements 203, 204, a thermister 222 is provided. Although not shown in FIG. 4, the ceramic surface type heater 224 is contacted by a thermister 223, thermo-switch or the like for detecting a temperature of a longitudinal end portion of the ceramic surface type heater 224.

The resistance values of the heat generating elements 203, 204 may be uniform or non-uniform along the longitudinal direction. For example, the consideration may be made to the fact that when a small size recording material is heated, the recording material does not pass the longitudinal end portions of the heat generating elements 203, 204, and therefore, the temperature of the longitudinal end portions tends to rise as compared with the central portions. In view of this, the resistance values may be made different between the longitudinal end portion and the central portion to make the heating temperature relative to uniform along the longitudinal direction of the heat generating elements 203, 204. Here, a heater having such a heat generating element is called tapered heater.

In order to improve a slidability of the heating sleeve 402, grease may be applied to the interface between the heating sleeve 402 and the ceramic surface type heater 224. The heat generating elements 203, 204 of the ceramic surface type heater 224 may be on the nip side or the opposite side.

As described in the foregoing, the fixing device is constituted at least by the endless belt 402, the heater 224 contacting the inner surface of the endless belt 402 and including the first heat generating element 203 and the second heat generating element 204 disposed downstream of the first heat generating element with respect to the feeding direction of the recording material, and the pressing member 403 forming the fixing nip for nipping and feeding the recording material by cooperation with the endless belt 402.

According to the heating film type fixing device 115 as described in the foregoing, the inner side surface of the heating sleeve 402 and the ceramic surface type heater 224 are directly contacted to each other, and therefore, the heat generated by the ceramic surface type heater 224 can be applied efficiently to the fixing nip. Therefore, the toner image can be heated with a sufficiently high heating temperature, and the rising and falling time of the electric energy consumption of the fixing device 115 can be reduced.

1-3. Circuit Structure for Electric Power Supply

Figure 2:
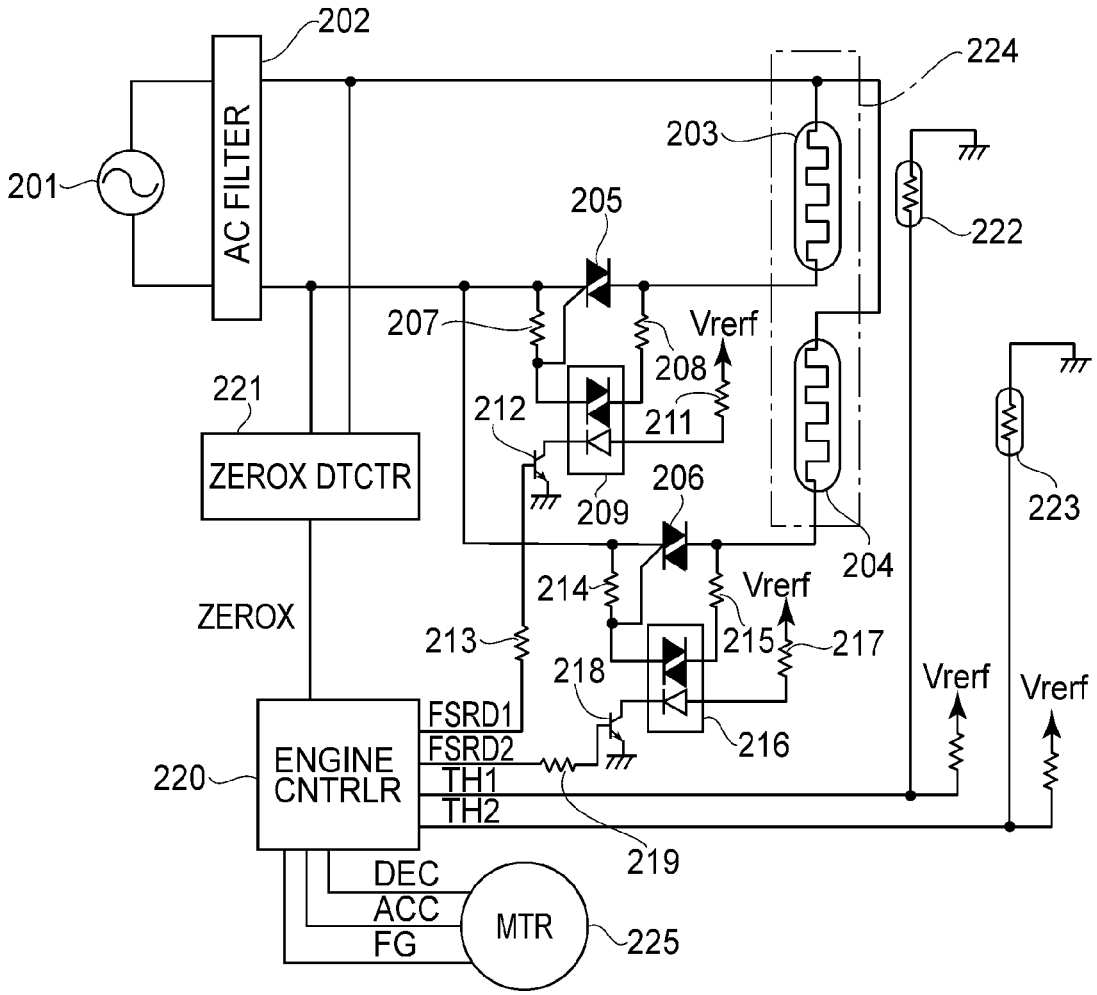
FIG. 2 is a schematic illustration of a circuit for electric power supply in the embodiment.

Referring to FIG. 2, the description will be made as to an electric power supply circuit for supplying electric power to the heat generating elements 203, 204 of the fixing device 115.

Designated by reference numeral 201 in FIG. 2 is an AC power source (commercial power source), and is connected to the heat generating element 203 and to the heat generating element 204 through an AC filter 202. The heat generating element 203 and the heat generating element 204 are connected in parallel, and the electric power supplied from the AC power source 201 are supplied to the heat generating element 203 and the heat generating element 204.

The electric power supply to the heat generating element 203 is rendered on and off by a TRIAC (first drive element) 205, and the electric power supply to the heat generating element 204 is rendered on and off by a TRIAC (second drive element) 206. Designated by 207, 208 are bias resistor for the TRIAC 205, and 209 is a photo-TRIAC coupler for assuring a creeping distance between the primary side and the secondary side. The TRIAC 205 is rendered ON by electric power supply to a light emitting diode of the photo-TRIAC coupler 209. Designated by 211 is a resistor for limiting a current through a photo-TRIAC coupler 205. Designated by 212 is a transistor for controlling ON/OFF of the photo-TRIAC coupler 205.

The transistor 212 operates in accordance with FSRD1 from an engine controller 220 through the resistor 213. The engine controller 220 supplies the respective electric power for the heat generating elements 203, 204 to a controller capable of controlling the heat generating elements, respectively. The FSRD1 outputs High when the transistor 212, and therefore, the photo-TRIAC are to be actuated, and outputs Low when the transistor 212, and therefore, the photo-TRIAC are to be deactuated.

Designated by 214, 215 are bias resistor for the TRIAC 205, and 216 is a photo-TRIAC coupler for assuring a creeping distance between the primary side and the secondary side. The TRIAC 206 is rendered ON by electric power supply to a light emitting diode of the photo-TRIAC coupler 216. Designated by 217 is a resistor for limiting a current through a photo-TRIAC coupler 206. Designated by 218 is a transistor for controlling ON/OFF of the photo-TRIAC coupler 206.

Designated by 221 is a ZEROX detection circuit (zero-cross detection circuit) connected to the 201 through the filter 202. The ZEROX detection circuit 221 send a pulse signal (ZEROX signal) indicative of the event that the AC power source voltage is not more than a threshold to the engine controller 220. The engine controller 220 detects an edge of the pulse of the ZEROX signal, and ON/OFF controls TRIAC 205, 206 by a phase control, wave number control and/or a hybrid control which will be described hereinafter.

Designated by 222 is a thermister for detecting a temperature of the ceramic surface type heater 224. Between the thermister 222 and the heat generating elements 203, 204 of the ceramic surface type heater 224, an insulative material having a sufficient withstand voltage is provided to assure an insulation distance.

The thermister 223 is a thermister for detecting a temperature of the longitudinal end portion of the ceramic surface type heater 224. The thermister 223 is provided at a longitudinal end portion of the ceramic surface type heater 224 with an insulative material having a sufficient withstand voltage therebetween to assure an insulation distance relative to the heat generating elements 203, 204.

The temperature detected by the thermisters 222, 223 is inputted to the engine controller 220 with A/D conversion. The temperature of the ceramic surface type heater 224 is monitored by the engine controller 220, which compares the detected temperature by the thermister 222 with a temperature (target temperature) set in the engine controller 220 to calculate the electric power to be supplied to the heat generating elements 203, 204. The electric power to be supplied is converted to a phase angle or a wave number, and in accordance with the resultant conditions, the engine controller 220 feeds the FSRD1 to the transistor 212 and FSRD2 to the transistor 218.

The signal FSRD1 is a signal for driving the transistor 212 to actuate the photo-TRIAC coupler 209, and the signal FSRD2 is a signal for driving the transistor 218 to actuate the photo-TRIAC coupler 216. Using the FSRD1, FSRD2, an amount of electric power to be supplied to the heat generating elements 203, 204 are controlled. Thus, the controller 220 for controlling the electric power to be supplied to the first heat generating element 203 and the second heat generating element 204 controls first drive element 205 and the second drive element 206 so that the first heat generating element 203 and the second heat generating element 204 are independently controllable. In this embodiment, the electric power supply to the heat generating elements 203 and 204 is controlled in accordance with the temperature of the heater 224, but in another example, an element for detecting a temperature of the endless belt 402, and the electric power supply may be controlled in accordance with the temperature of the endless belt 402.

Designated by 225 is a driving source for a feeding type for feeding of the recording material, and a motor as a driving source for the photosensitive drum 109. The engine controller 220 receives speed signal pulses (FG) outputted from the motor 225 to determine the speed of the motor 225. In addition, it compares FG signal and a reference clock signal and outputs an acceleration signal (ACC) and a deceleration signal (DEC) to the motor 225 to control the recording material feeding speed and the process speed. Furthermore, it switches the recording material feeding speed in accordance with conditions such as the size of the recording material by instructing the motor to change the rotational speed thereof.

Figure 3:
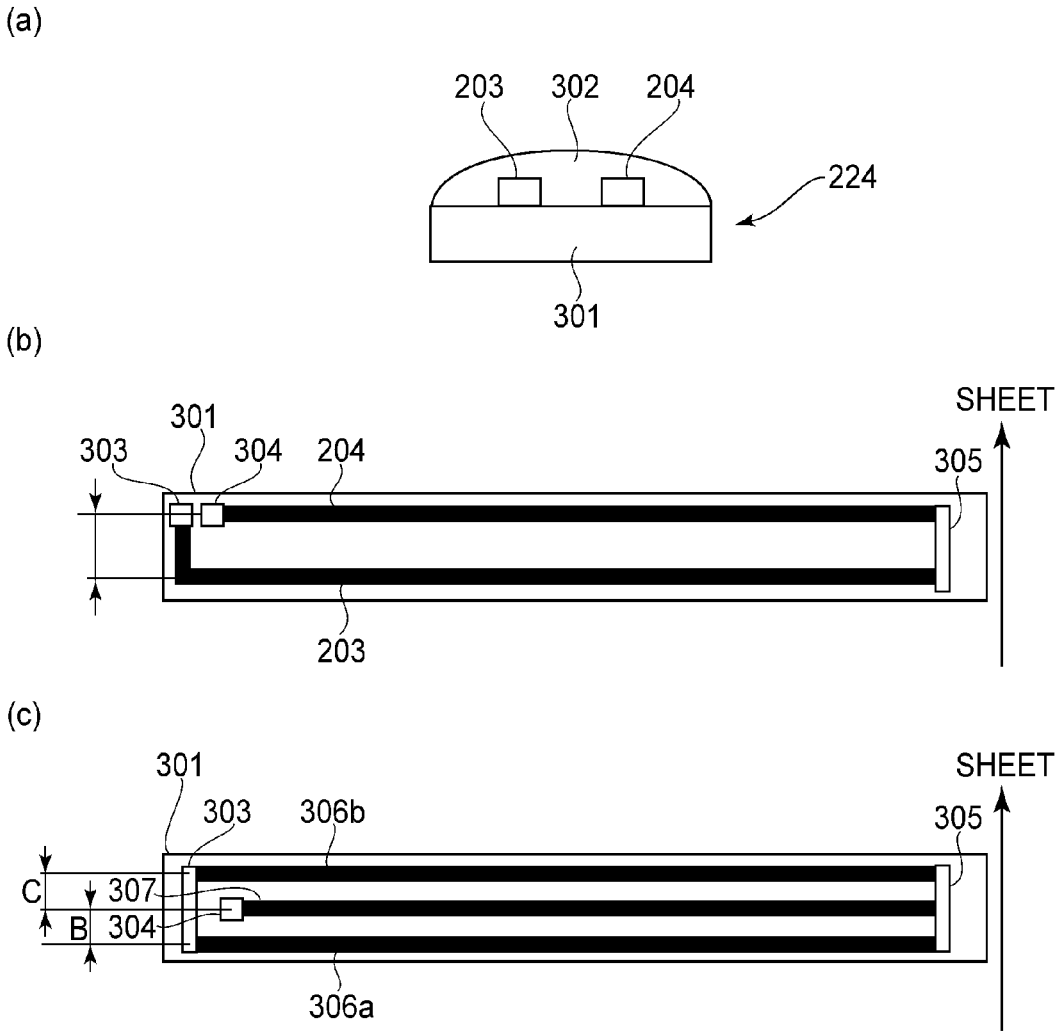
FIG. 3 is a schematic illustration of a ceramic surface type heater in this embodiment.

Referring to part (a) and (b) of FIG. 3, the description will be made as to a connecting portion between the heat generating element of the ceramic surface type heater 224 and the above-described electric power supply circuit. Part (a) of FIG. 3 is a schematic sectional view of the ceramic surface type heater 224. Part (b) of FIG. 3 illustrates a configuration of the heat generating element of the ceramic surface type heater 224. A plurality of such heat generating elements are arranged in the recording material feeding direction such that the longitudinal directions thereof and the recording material feeding direction are perpendicular to each other. Part (c) of FIG. 3 shows a heater used in a fixing device of a third embodiment.

The ceramic surface type heater 224 shown in part (b) of FIG. 3 is provided with two heat generating elements 203, 204 and electrode portions 303, 304, 305. The heat generating element 203 is disposed relatively upstream with respect to the recording material feeding direction, and the heat generating element 204 is disposed relatively downstream. An electrode portion 303 is for electric power supply to the heat generating element 203, and an electrode portion 304 is for electric power supply to the heat generating element 204. An electrode portion 305 is a common electrode for heat generating elements 203, 204. The common electrode 305 is connected to a HOT side terminal of the AC power source 201, and the electrode portion 303 and the electrode portion 304 are connected to the TRIAC 205 and TRIAC 206, respectively.

1-4. Phase Control and Wave Number Control

The electric power is supplied to the heat generating elements 203, 204 of the ceramic surface type heater 224 under a hybrid control which is a combination of the phase control and the wave number control. The phase control and the wave number control will be described.

In the phase control, the heater is rendered ON in a phase angle range in one half wave of the alternating current. By the phase control, the current flows in each half wave, and therefore, the change amount and change cyclic period is small, and for this reason, the fluctuation of illumination equipment in the same office or room is suppressed. In order to suppress a flickering of illuminating equipment, this control is advantageous. However, upon ON/OFF of the heater, abrupt current variation occurs with the result of generation of harmonic current, and therefore, this control is not preferable from the standpoint of suppressing the harmonic current.

On the other hand, in the wave number control, the ON/OFF of the heater using one half wave of the AC power source as a unit. In the wave number control, the heater is rendered ON/OFF for each half wave, and therefore, the harmonic current does not tend to occur, and is advantageous in suppressing the harmonic current. However, the flickering tends to occur since the voltage variation is larger than in the phase control.

In addition, in the hybrid control combining the phase control and the wave number control, the harmonic current and production of the switching noise can be suppressed, as compared with the case of the phase control alone. In addition, as compared with the case of the wave number control alone, the flickering can be reduced, and therefore, electric power control to heater can be controlled with larger steps. As for the details of the hybrid control in this embodiment will be described hereinafter.

1-5. Zero-Cross Detection Circuit and ZEROX Waveform

Figure 5:
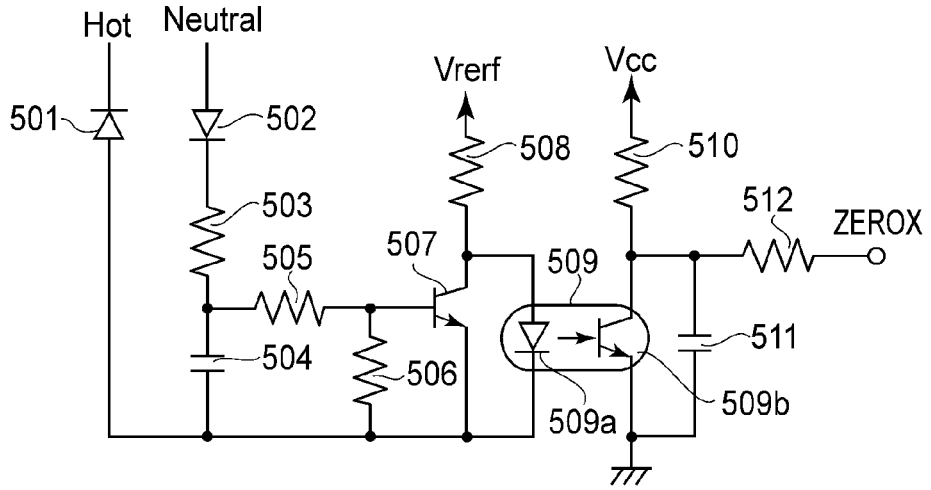
FIG. 5 illustrates a zero-cross detection circuit, an AC power source waveform and a zero-cross waveform in this embodiment.
Figure 5:
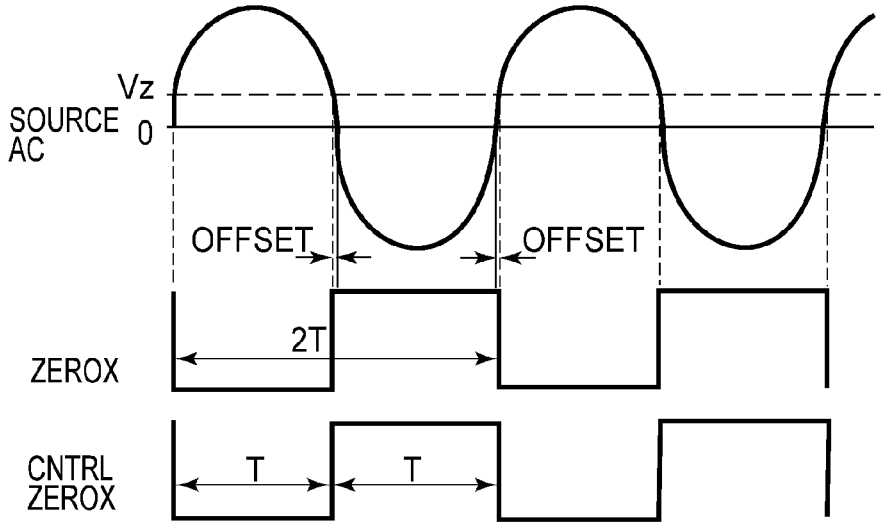

Part (a) of FIG. 5 shows details of the zero-cross detection circuit 221 (ZEROX detection circuit). Part (b) of FIG. 5 shows an AC power source waveform and a ZEROX waveform. The AC voltage from the AC power source 201 is inputted to the zero-cross detection circuit 221 shown in part (a) of FIG. 5, and is subjected to half wave rectification by rectifying devices 501, 502. In this embodiment, a Neutral side is rectified. The AC voltage having been subjected to the half wave rectification is inputted to a base of the transistor 507 through a resistor 505, a capacitor 504 and current limiting resistors 503, 506. When the Neutral side potential is higher than a threshold voltage Vz determination by an unshown full wave rectification diode bridge, rectifying devices 501, 502 and the transistor 507, that is, the potential of the Neutral side is higher than a Hot side potential, the transistor 507 is rendered ON. On the other hand, when the Neutral side potential becomes lower than the Hot side potential, the transistor 507 is rendered OFF.

A photo-coupler 509 is an element for assuring a creeping distance between the primary and secondary sides, and resistors 508 and 510 are resistors for limiting the current through the photo-coupler 509. When the Neutral side potential becomes higher than the Hot side potential, the transistor 507 is rendered ON, and therefore, a light emitting diode 509*a* in the photo-coupler 509 is deactuated, the photo-transistor 509*b* is rendered OFF, and the output voltage of the photo-coupler 509 becomes High.

On the other hand, when the Neutral side potential becomes lower than the Hot side potential, the transistor 507 is rendered OFF, and therefore, the light emitting diode 509*a* in the photo-coupler 509 is actuated, the photo-transistor 509*b* is rendered ON, and the output voltage of the photo-coupler 509 becomes Low. Thus, the ZEROX signal is a pulse signal having a level switching depending on whether the Hot side potential relative to the Neutral side potential is higher or lower than the threshold voltage Vz.

The output of the photo-coupler 509 is supplied to the engine controller 220 as a zero-cross (ZEROX) signal through the resistance 512. The engine controller 220 detects rising and falling edges of the zero-cross signal, and renders the TRIACs 205, 206 on the basis of the edges as triggers.

However, since the threshold voltage Vz is not 0V ($Vz \neq 0$), the rising edge of the ZEROX signal is offset from the actual zero-cross point. Similarly, the falling edge is offset therefrom. If the ZEROX signal is used as a trigger signal for the phase control as it is, the time difference corresponding to the offset becomes phase deviation by positive and negative polarity of the inputting power source. In view of this, the engine controller 220 measures a cyclic period (2T) of the fallings of the ZEROX signal, and calculates one half T of the time period. Thereafter, the engine controller 220 generates a plausible rising edge at the time T. Hereinafter, a combination of the falling edge and the plausible rising edge is called control ZEROX signal. The engine controller 220 effects the control using the control ZEROX signal as the trigger signal.

1-6. Hybrid Control

Figure 6:
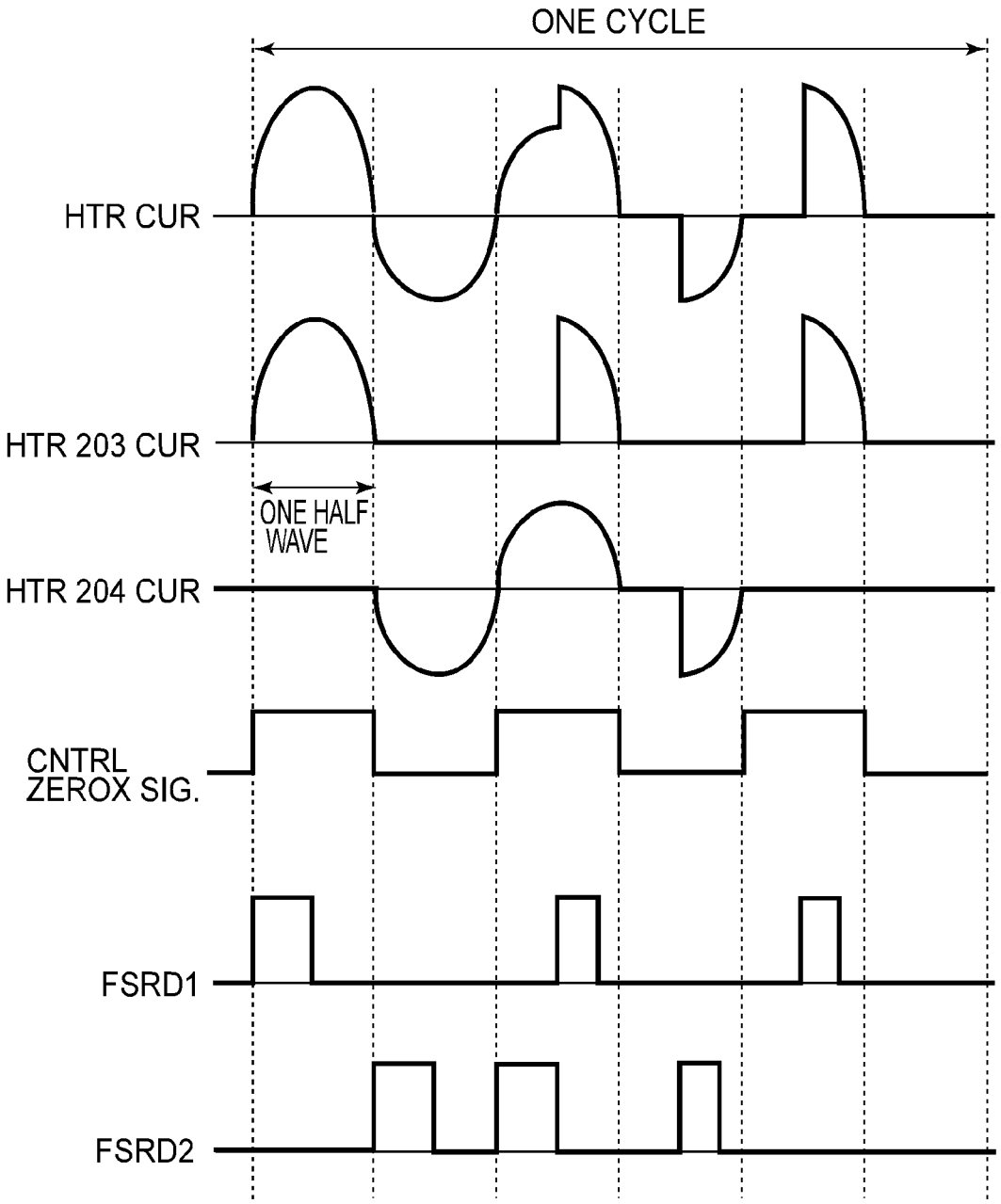
FIG. 6 shows a current waveform in this embodiment.

Referring to FIG. 6, the hybrid control in this embodiment will be described. As described hereinbefore, the hybrid control is a combination of the wave number control with which ON/OFF is effected using the half wave of the AC power source as a unit in one control cyclic period, and the phase control with which the electric power is supplied to the heater by rendering ON at a phase angle in one half wave. In the hybrid control, the influence of the flickering and the influence of the flickering are balanced, because both of the wave number control causing less harmonic current despite less suppression of flickering and the phase control suppressing the flickering despite production of harmonic current are used. For example, one cyclic period has continuous 8 half waves, in each of which the number of ON half waves and the state phase angle are changed so that the electric power supply to the heater is controlled.

Referring to FIG. 6, FSRD1 and FSRD2 are the waveforms which are outputted from the engine controller 220 described in FIG. 2 and which are outputted on the basis of the control ZEROX signal described in conjunction with FIG. 5. In the case of hybrid control, the heater is rendered ON a 0 phase or another arbitrary phase, and therefore, as shown in FIG. 6, the pulse is outputted at a desired phase on the basis of the control ZEROX signal.

A current waveform flowing through respective heat generating element under the control of FSRD1 and FSRD2 appears in the current waveform of the heat generating element 203 and the current waveform of the heat generating element 204. In this embodiment, the resistance values of the heat generating element 203 and the heat generating element 204 are made different from each other, and therefore, the amplitudes of the current waveforms are different from each other. Therefore, the top current waveform of the heat generating element shown in FIG. 6 are a composite waveform of the currents flowing through the heat generating element 203 and through the heat generating element 204.

1-7. Control Pattern of Electric Power Control

Referring to FIG. 7, the description will be made as to a control pattern when the electric power supply to the heat generating elements 203, 204 are controlled by the above-described hybrid control. FIG. 7 shows a control pattern of the hybrid control using 8 half waves as a control cyclic period, for the heat generating element 203 and the heat generating element 204. Part (a) of FIG. 7 is a table for the first heat generating element 203, and (b) is a table for the second heat generating element 204. As will be understood, these tables are the same. Therefore, one table may be used for both of the heat generating elements. A leftmost row shows 40 control levels into which 0%-100% of the electric power supplied to the heat generating element is divided. The lines show control patterns in one control cyclic period (8 half waves) of the control levels. The control pattern is indicated by a percentage of the ON period in one half wave. In each cell, the percentage is from 100-0% in 2.5% increments.

Figure 8:
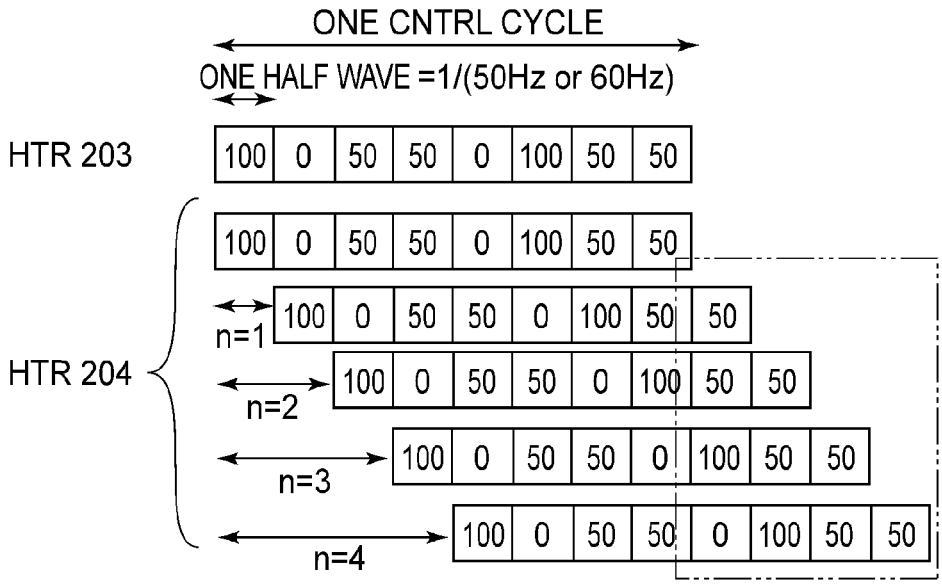
FIG. 8 shows a control pattern and a current waveform in this embodiment.
Figure 8:
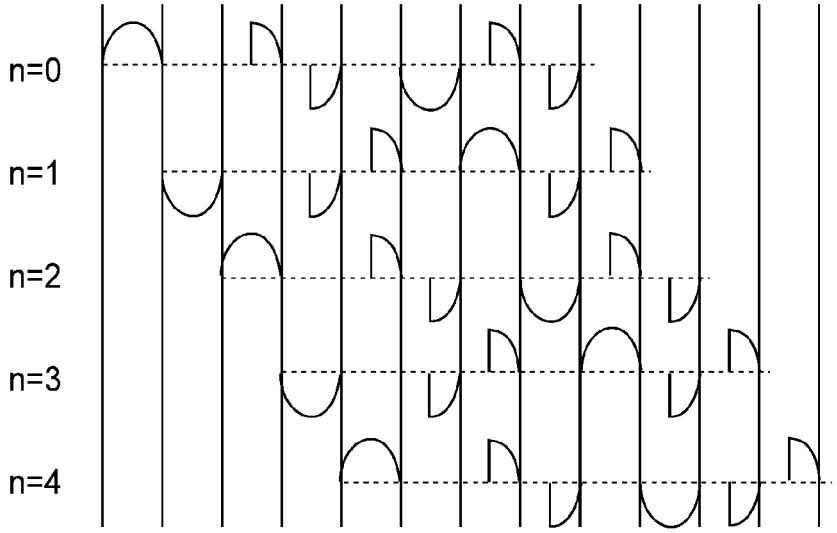

In each of the heat generating elements, the positive electric power supply phase of the AC power source and the negative electric power supply phase in one control cyclic period are symmetrical with each other. In other words, the current waveforms in the positive side and the negative side within one control cyclic period are symmetrical with each other. The upstream heat generating element 203 and the downstream heat generating element 204 are controlled independently from each other by the above-described heater driving circuit using the patterns shown in parts (a) and (b) of FIG. 7. For example, when 50% electric power is to be supplied to the heat generating elements 203, 204, the upstream heat generating element 203 selects 50% of (a) and the downstream heat generating element 204 also selects 50% of (b). As a total, 50% electric power is supplied to the heat generating element. The control patterns may be stored in the engine controller 220 shown in FIG. 2, and a proper one may be selected in response to the desired electric power. Part (b) of FIG. 8 shows a current waveform flowing through the heat generating element. Part (b) of FIG. 8 shows a current waveform when 50% in FIG. 7 is selected as a control level (control pattern). The controller selects one of the control levels (control patterns) in accordance with the temperature of the heater or the endless belt. The cyclic period of renewal of the control level is one control cyclic period.

The controller sets the control pattern for each one control cyclic period including a plurality of continuous half waves of the commercial AC waveform.

1-8. Time Difference in Control Start of Control Pattern

Referring to FIG. 8, a time difference in control start of the control pattern in this embodiment will be described. Part (a) of FIG. 8 is control patterns when 50% electric power of FIG. 7 is supplied. The control start timing for the heat generating element 204 is offset from that for of the heat generating element 203, and the amount of offset varies. The amount of the offset is n times one half wave. Part (b) of FIG. 8 shows a current waveform when the heat generating element is controlled using the pattern shown in (a) of FIG. 8. Here, the first half wave of one control cyclic period constituted by the plurality of half waves is the start time of the one control cyclic period. One half of the cyclic period (one half wave) of the AC power source waveform is dependent upon the frequency of the AC power source and is expressed as an inverse number of the frequency of the AC power source.

In this embodiment, as a method for reducing the fixing non-uniformity, the control start timing of the upstream heat generating element 203 and the control start timing of the downstream heat generating element 204 are offset from each other so that a point on the recording material already heated by the upstream heat generating element 203 is not heated again by the downstream heat generating element 204. That is, the difference of the control start times between the heat generating element 203 and the heat generating element 204 are determined by the following:

$$\frac{1}{2f} \times n \neq \frac{A}{v} \tag{1}$$

Here, v is a recording material feeding speed [mm/sec], A is a distance [mm] between center axes of the heat generating elements in a widthwise direction (recording material feeding direction), and f is a frequency of the AC of the power source. In addition, n is an integer indicating the control start time difference in a number of the half waves. Assuming that the frequency f of the AC power source is constant, the control pattern start time difference between the upstream heat generating element 203 and the downstream heat generating element 204 is selected as an optimum n satisfying equation (1). By doing so, the fixing non-uniformity can be reduced.

Similarly, when the kind or the like of the recording material is changed, the feeding speed v [mm/sec] is switched to provide an optimum fixing property, and n of formula (1) is determined corresponding to the new feeding speed v, and the control start time difference is changed. By doing so, the control pattern start time difference can be determined so as to reduce the fixing non-uniformity when the feeding speed is switched. More particularly, the timing at which a portion on the recording material having been heated by the heat generating element 203 reaches the heating region of the heat generating element 204 is made different from the electric power supply timing to the heat generating element 204.

The case in which the frequency of the AC power source is 50 Hz, the distance A between the heat generating element is 1.5 [mm], the feeding speed v is either 150 [mm/sec] or 200 [mm/sec] is taken for instance. These values are substituted in the equation, and the result is that n when the feeding speed is switched should be $n \neq 1$ in the case of $v=150$, and should be $n \neq 0.75$ in the case of $v=200$. By setting n so as to satisfy them, the fixing non-uniformity can be reduced. In this embodiment, $n=2$ for the case of $v=150$ and $n=3$ for the case of $v=200$ are selected. The values of n are stored in the engine controller 220 beforehand.

On the basis of n determined by equation (1), the downstream heat generating element 204 starts the electric power supply with a delay of $\frac{1}{2}f \times n$ [sec] from the control start time of the upstream heat generating element 203. During the period from the control start of the upstream heat generating element 203 to the control start of the downstream heat generating element 204, the electric power supply to the heat generating element 204 is unnecessary, but the control may be started from the control pattern for the next control cyclic period shown in a broken line in FIG. 8. Or, instead of deviating the control start time, a control pattern of the FSRD1 and FSRD2 having a relation of the $\frac{1}{2}f \times n$ [sec] delay may be stored in the engine controller 220, and the control pattern is switched in accordance with the feeding speed.

Figure 9:
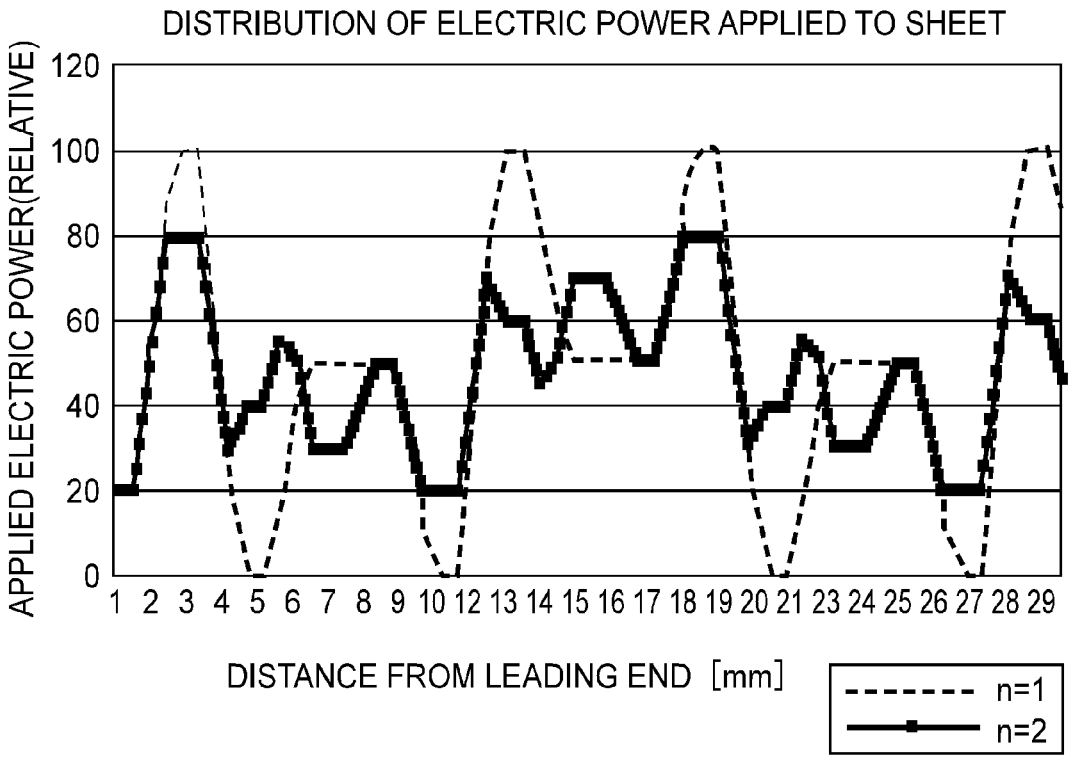
FIG. 9 shows an electric power distribution given to the recording material in this embodiment.

Reference FIG. 9, the description will be made as to a fixing non-uniformity reducing effect when the control start time of the heat generating element 203, 204 is deviated as described above. FIG. 9 is a graph of the electric power supplied to the recording material from the heat generating elements 203, 204 when the feeding speed v [mm/sec] of the recording material is 150 [mm/sec].

The abscissa of the graph is distances of the recording material from the leading end thereof in the recording material feeding direction (the position on the recording material). The ordinate is relative values of total electric power applied by the heat generating elements at respective positions of the recording material. The broken line is an electric power distribution when the control start time difference n=1 which is not preferable from the standpoint of fixing non-uniformity, and the solid line is an electric power distribution when the control start time difference n=2 which is one of the cases capable of reducing the fixing non-uniformity.

As will be understood from the graph, when n=1, a variation of the electric power is large, and when n=2, the difference is small. Thus, by deviating the timing of the control start in accordance with the feeding speed, the non-uniformity of the electric power applied to the recording material changes. Therefore, by an optimum control start time difference on the basis of equation (1), the reducing effect of the fixing non-uniformity can be provided.

1-9. Control Flow Chart

Figure 10:
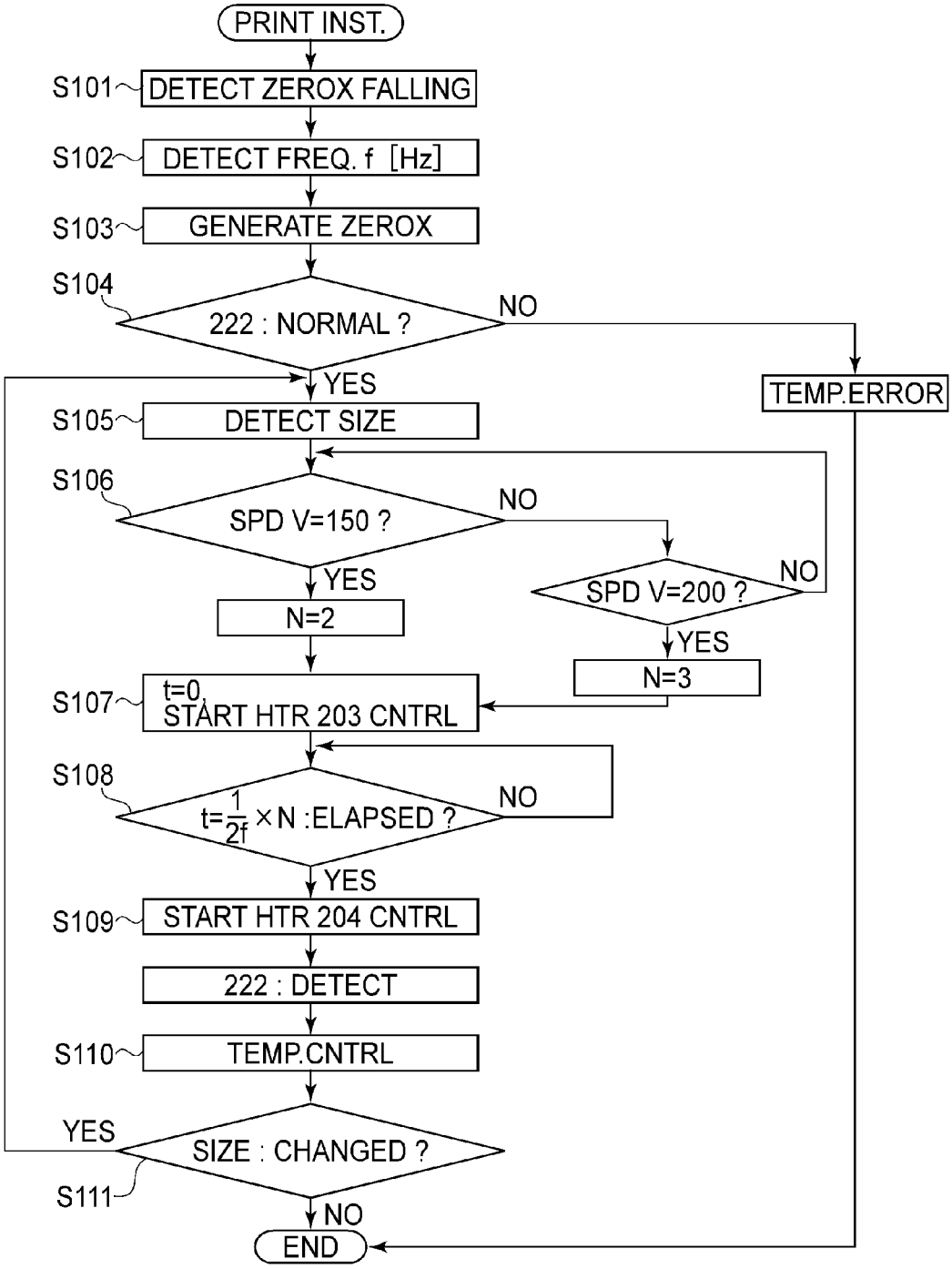
FIG. 10 is a control flow chart illustrating a control flow in this embodiment.

Referring to FIG. 10, a control flow chart used in this embodiment will be described. When the engine controller 220 receives print starting instructions, the falling edge of the ZEROX signal of the AC power source is detected in step S101. In step S102, the engine controller 220 calculates the frequency of the AC power source from the cyclic period of the falling edges. In step S103, the control ZEROX signal described with FIG. 5 is generated.

Then, in step S104, if the ceramic surface type heater 224 is not in an abnormal state judging from the temperature detection of the thermister 222, a size or the like of the recording material is detected in step S105, and the feeding speed is determined from the condition such as the size of the recording material in step S106. Here, the n in formula (1) is read in accordance with the feeding speed from the memory of the engine controller 220. When the apparatus becomes capable of starting the printing operation, a temperature control start time for the ceramic surface type heater 224 is set to t=0, and the electric power supply control to the upstream heat generating element 203 is started.

Thereafter, in steps S108, S109, when the time corresponding to n times the half wave elapses, the electric power supply control to the downstream heat generating element 204 starts. Thereafter, in step S110, the temperature control is continued so that the temperature of the ceramic surface type heater 224 reaches a desired level, while monitoring the temperature of the ceramic surface type heater 224 by the thermister 222. If the feeding speed is changed during the printing operation due to the change of the recording material size, the optimum value n is again obtained in accordance with the feeding speed.

As described in the foregoing, according to this embodiment, by controlling the heat generating element such that the difference between the control start times is switched when the feeding speed of the recording material is switched, an image forming apparatus with which images having suppressed fixing non-uniformity can be produced irrespective of switching of the feeding speed can be provided.

Second Embodiment

An image forming apparatus according to a second embodiment of the present invention will be described. The structure of the image forming apparatus and the structure of the fixing device are the same as those of the first embodiment, but are different in that the heat generating element is controlled using a wave number control effective to suppress the harmonic current. In the description of this embodiment, the same reference numerals as in Embodiment 1 are assigned to the elements having the corresponding functions in this embodiment, and the detailed description thereof is omitted for simplicity.

2-1. Electric Power Control

Figure 11:
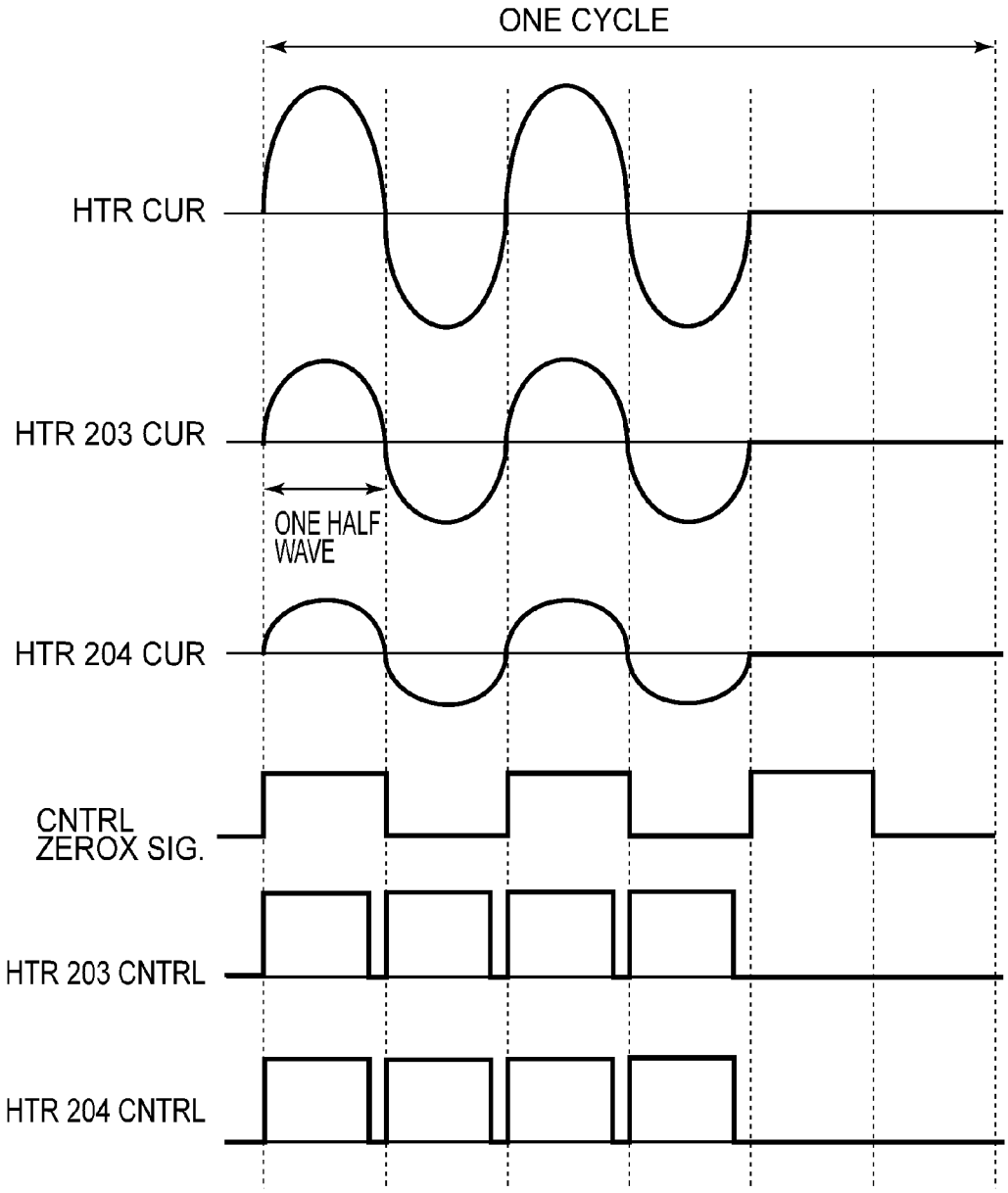
FIG. 11 shows a current waveform according to a second embodiment of the present invention.

In this embodiment, the electric power to the heat generating element 203 and the heat generating element 204 by the wave number control as shown in FIG. 11. The wave number control is as described in the foregoing, but the electric power supply to the heater can be controlled by changing the state and the number of the ON half waves in one control cyclic period consisting of 12 half waves, for example.

In the wave number control, an entire half wave is either in ON or in OFF state, and therefore, the ON signal is outputted at phase 0 of the ZEROX signal as shown in FIG. 11. The current waveforms flowing through the heat generating elements 203, 204 are as shown in the Figure. In this embodiment, the resistance values of the heat generating element 203 and the heat generating element 204 are different from each other, and therefore, the amplitudes of the current waveforms are different. A top heat generating element current waveform in FIG. 11 is a composite waveform of the currents flowing through the heat generating element 203 and the heat generating element 204.

2-2. Control Pattern of the Electric Power Control

Referring to FIG. 12, the control pattern at time of controlling the electric power supply to the heat generating elements 203, 204 by the wave number control will be described. Part (a) of FIG. 12 shows a control pattern when the electric power supply to the heat generating element 203 is controlled by the wave number control with one control cyclic period including 12 half waves. Part (a) of FIG. 12 is a table for the first heat generating element 203, and (b) is a table for the second heat generating element 204. As will be understood, these tables are the same. Therefore, one table may be used for both of the heat generating elements. A leftmost row shows 12 control levels into which 0%-100% of the electric power supplied to the heat generating element is divided. The lines show control patterns in one control cyclic period (12 half waves) of the control levels. The control pattern is indicated by a percentage of the ON period in one half wave. Since the wave number control is used here, each cell of the control pattern Table has 100% or 0%. Part (b) of FIG. 12 shows a control pattern for the heat generating element 204.

The upper part and the lower part are set to be symmetrical with each other so that the ON numbers of the positive half waves and the negative half waves are the same in the control patterns of the heat generating elements. By the above-described electric power supply circuit, of the upstream heat generating element 203 and downstream of heat generating element 204 are controlled independently from each other by the patterns of (a) and (b) of FIG. 12.

For example, case 50% electric power is to be supplied to the heat generating element, 50% of (a) of FIG. 12 is selected for the upstream heat generating element 203, and 50% of (b) of FIG. 12 is selected for the downstream heat generating element 204. Each of the heat generating elements are supplied with 6 half waves of the 12 half waves, and therefore, the heat generating elements are supplied with 50% electric power. Such control patterns are stored beforehand in the engine controller 220, and are selected in accordance with the electric power to be supplied.

2-3. Time Difference in Control Start of Control Pattern

Figure 13:
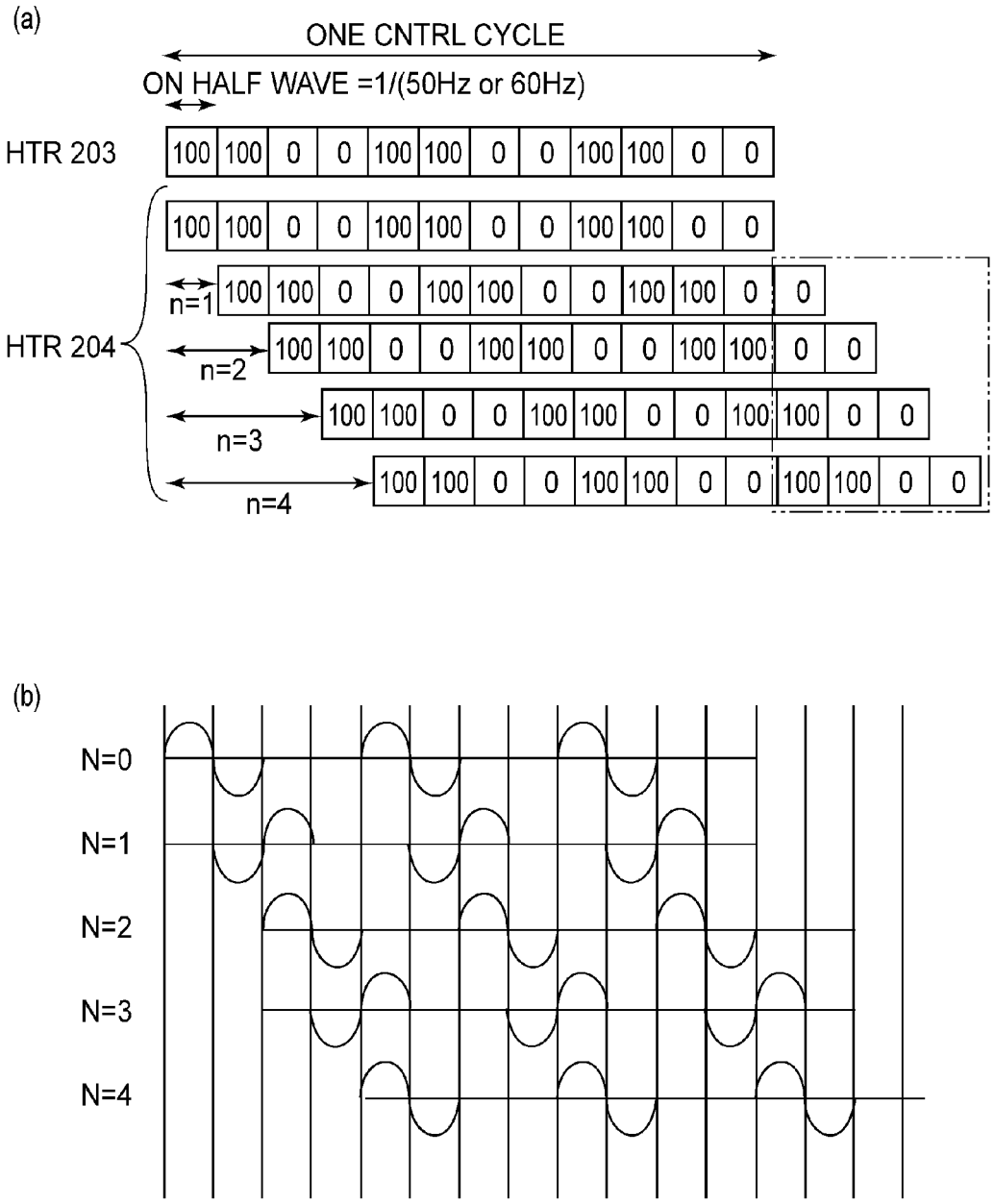
FIG. 13 shows a control pattern and a current waveform in the second embodiment.

Referring to FIG. 13, a time difference in control start of the control pattern in this embodiment will be described. Part (a) of FIG. 13 is a control pattern when the 50% electric power shown in FIG. 12 is supplied. The control start timing for the heat generating element 204 is offset from that for the heat generating element 203, and the amount of offset varies. The amount of the offset is n times one half wave. Part (b) of FIG. 13 shows a current waveform when the heat generating element is controlled in accordance with the control pattern shown in part (a) of FIG. 13.

The case in which the frequency of the AC power source is 50 Hz, the distance A between the heat generating element is 2 [mm], the feeding speed v is either 150 [mm/sec] or 200 [mm/sec] is taken for instance. In this case, n when the feeding speed is switched should be $n \neq 1.3$ in the case of v=150, and should be $n \neq 1$ in the case of v=200.

However, even if the n is determined in accordance with formula (1), the difference of the voltage variation when the electric power supplies to the heat generating element 203 and the heat generating element 204 are simultaneously rendered ON or OFF, may be so large that the flickering of the illuminating equipment is influenced. Value of n determined by formula (1) can be determined so as to decrease a ratio of simultaneous electric power supply to the heat generating element 203 and the heat generating element 204, by which the flickering as well as the fixing non-uniformity can be reduced. In this embodiment, n=2 rather than n=0 when v=150, and n=3 rather than n=4 when v=200. With the Such values, the flickering can be reduced.

Figure 14:
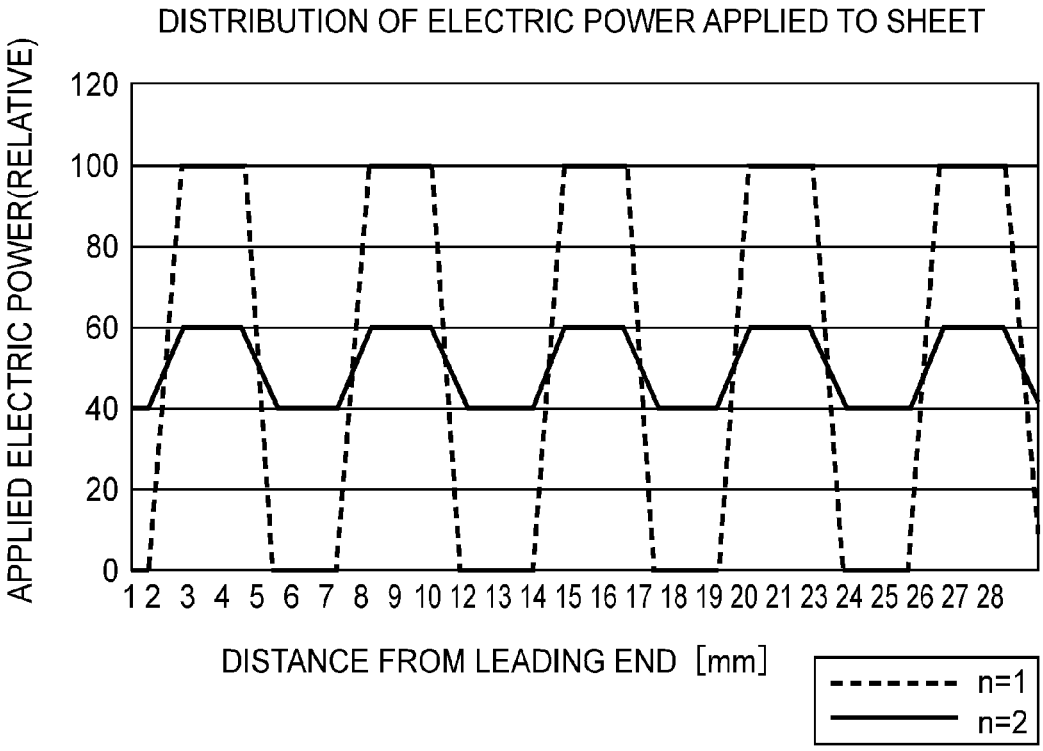
FIG. 14 shows an electric power distribution given to the recording material in the second embodiment.

Referring to FIG. 14, the fixing non-uniformity reducing effect in this embodiment will be described. This Figure shows the electric power applied to the recording material by the heat generating element when the feeding speed v is 200 [mm/sec]. The abscissa of the graph is a distance from the leading end of the recording material in the feeding direction of the recording material. The ordinate is relative values of total electric power applied by the heat generating elements at respective positions of the recording material. The broken line is an electric power distribution when the control start time difference n=1 which is not preferable from the standpoint of fixing non-uniformity, and the solid line is an electric power distribution when the control start time difference n=3 which is the cases capable of reducing the fixing non-uniformity.

When n=1, a variation of the electric power is large. On the other hand, when n=2, the difference is small. In such a manner, non-uniformity of the electric power applied to the recording material can be changed by deviating the control start timing on the basis of equation (1). By determining an optimum control start time difference, reducing effect for the fixing non-uniformity can be provided.

Third Embodiment

An image forming apparatus according to a third embodiment of the present invention will be described. In the description of this embodiment, the same reference numerals as in Embodiment 2 are assigned to the elements having the corresponding functions in this embodiment, and the detailed description thereof is omitted for simplicity.

3-1. General Structure of the Fixing Device

A schematic structure of the fixing device particularly the configuration of the heat generating element of the ceramic surface type heater 224 in this embodiment will be described. Part (c) of FIG. 3 shows a configuration of the heat generating element of the ceramic surface type heater 224 in this embodiment. While two heat generating elements are arranged in the feeding direction of the recording material in the first and second embodiments, three heat generating elements are provided in this embodiment.

A distance between a center axis of the upstreammost heat generating element **306*a* and a center axis of a middle heat generating element 307 in the widthwise direction (in the feeding direction of the recording material) is B [mm], and a distance between the downstreammost heat generating element 306*b* and the middle heat generating element 307 in the widthwise direction (in the feeding direction of the recording material) is C [mm]. The heat generating element 306*b* and the heat generating element 306*a* have a common electrodes 303, 305**, and therefore, they are subjected to the same control.

3-2. Time Difference in Control Start of Control Pattern

Figure 15:
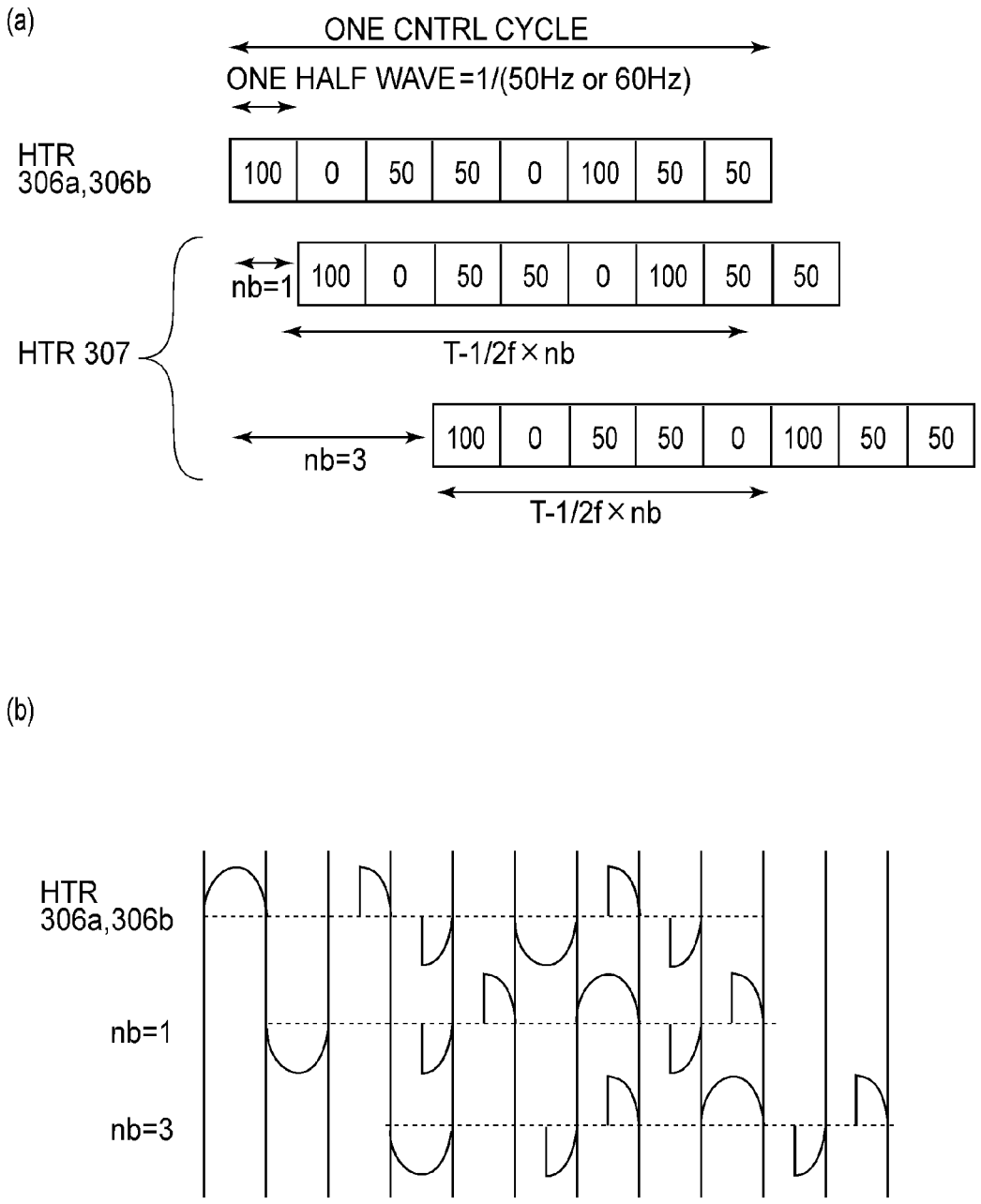
FIG. 15 shows a control pattern and a current waveform in a third embodiment of the present invention.

Referring to FIG. 15, the control pattern and the control start time difference will be described. Part (a) of FIG. 15 shows a control pattern of this embodiment, and (b) shows a current waveform flowing through the heat generating element.

Similarly to the first embodiment, the control start time difference of the equation (2) can be determined from the distance between the upstream heat generating element **306*a* and the middle heat generating element 307 and the feeding speed v. Similarly, the control start time difference of the formula (3) can be determined from the distance C between the heat generating element 306*b* and the heat generating element 307** and the feeding speed v.

$$\frac{1}{2f} \times nb \neq \frac{B}{v} \tag{2}$$

$$\frac{1}{2f} \times nc \neq \frac{C}{v} \tag{3}$$

However, the heat generating element **306*b* is driven at the same timing as the heat generating element 306*a*, and therefore, the control start time difference between the heat generating element 306*b* and the heat generating element 307 is necessitated by the time difference between the control start time of the heat generating element 307 and the top T [sec] of the next control cyclic period for the heat generating element 306***a* (equation (4)).

$$nc = \left(T - \frac{1}{2f} \times nb\right) \times 2f \tag{4}$$

Therefore, equation (3) can be replaced by:

$$T - \frac{1}{2f} \times nb \neq \frac{C}{v} \tag{5}$$

Thus, the control start time difference between the heat generating element 306 and the heat generating element 307 for reducing the fixing non-uniformity is nb satisfying equation (2) and equation (5). In this embodiment, these frequency of the AC power source is 50 [Hz], the distances between the centers of the heat generating elements are 1 [mm] and 1.5 [mm], respectively, the feeding speed is v=150 [mm/sec], and one control cyclic period T including 8 half waves is 80 [msec]. From equation (2) and equation (5) under this condition, nb=3 is selected as the value satisfying nb≠1, nb≠7, in this embodiment.

Figure 16:
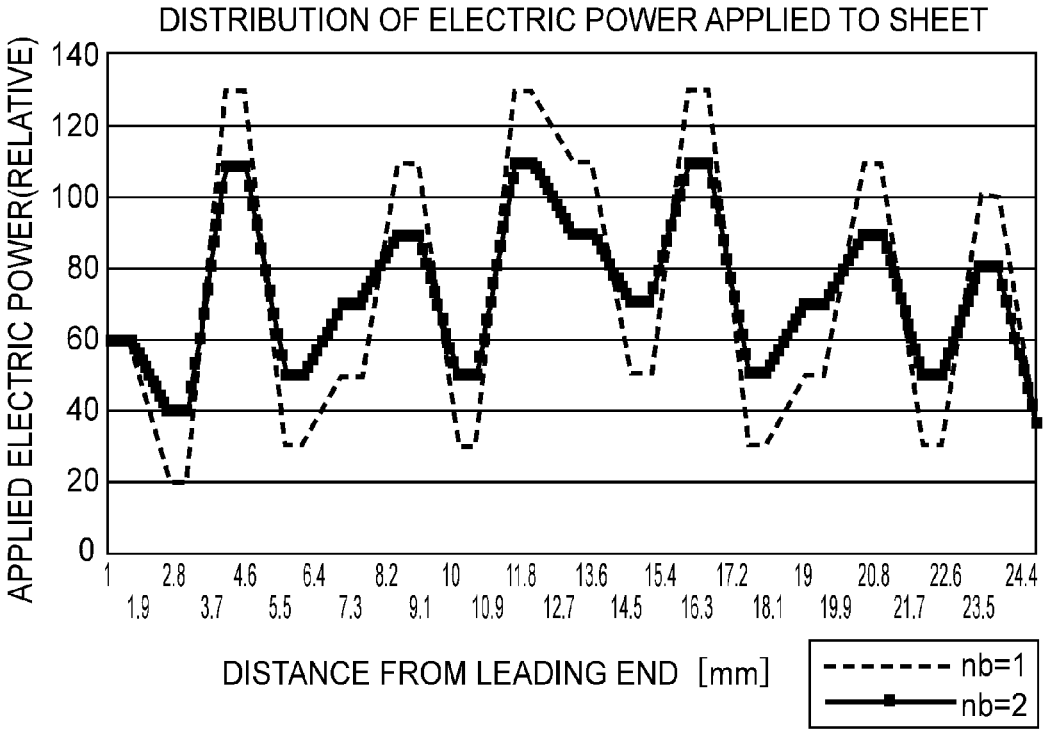
FIG. 16 shows an electric power distribution given to the recording material in the third embodiment.

Referring to FIG. 16, the fixing non-uniformity reducing effect in this embodiment will be described. The graph of FIG. 16 shows electric power applied to the recording material through the heat generating element when the recording material feeding speed v is 150 [mm/sec]. The abscissa of the graph is distances from the leading end of the recording material in the recording material feeding direction, and the ordinate is relative values of the total electric power applied from the heat generating elements at each position on the recording material.

The broken line is an electric power distribution when the control start time difference nb=1 (not preferable for fixing non-uniformity suppression), and the solid line is an electric power distribution when the control start time difference nb=3 (preferable for fixing non-uniformity suppression). When n=1, a variation of the electric power is large. When n=3, a variation of the electric power is small.

Thus, using the configuration of the heat generating element shown in part (c) of FIG. 3, the electric power applied to the recording material can be changed by changing the control start time for each feeding speed of the recording material. Therefore, by determining an optimum control start time difference, the fixing non-uniformity reducing effect can be provided. A control flow chart for this embodiment is similar to that of FIG. 10, and therefore, the description thereof is the same as that in Embodiment 1, and the detailed description thereof is omitted.

As described in the foregoing, according to this embodiment of the present invention, even in the case that two or more spaces between the heat generating elements, the images can be formed with suppressed fixing non-uniformity, irrespective of switching of the feeding speed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 2010-279299 filed Dec. 15, 2010 which is hereby incorporated by reference.

What is claimed is:

1. An image forming apparatus comprising:

a fixing portion configured to fix an unfixed image formed on a recording material thereon, said fixing portion including, an endless belt, a heater configured to contact an inner surface of said endless belt, said heater including a first heat generating element configured to generate heat by electric power supplied from an AC power source and a second heat generating element configured to generate heat by the electric power supplied from the AC power source, said second heat generating element being provided downstream of said first heat generating element with respect to a feeding direction of the recording material; and a pressing member cooperative with said heater to form a fixing nip for nipping and feeding the recording material through said endless belt; and a controller configured to effect control comprising a plurality of control cycles to control electric power to be supplied to said first heat generating element and said second heat generating element, said controller controlling said first heat generating element and said second heat generating element independently from each other, wherein said plurality of control cycles each include a plurality of continuous half waves of AC waveforms in which control patterns are set for respective control cycles, wherein start and end points of each control cycle are zero-cross points of the AC waveform, wherein a number of continuous half waves of AC waveforms in a control cycle for said first heat generating element and a number of continuous half waves of AC waveforms in a control cycle for said second heat generating element are the same, wherein said image forming apparatus is configured to set a plurality of feeding speeds of the recording material, and said controller changes a difference between a phase of the control cycle for said first heat generating element when said first heat generating element is supplied with the electric power and a phase of the control cycle for said second heat generating element when said second heat generating element is supplied with the electric power, wherein the difference is an integer multiple of a half wave of AC waveforms, and wherein the integer multiple depends on the distance between the first and second heat generating elements.

2. The image forming apparatus according to claim 1, wherein said controller controls current waveforms flowing through said first heat generating element and said second heat generating element so as to be cyclic control patterns corresponding to a temperature of said endless belt or said heater, each of the control patterns comprising a plurality of continuous half waves of AC waveforms.

3. The image forming apparatus according to claim 2, further comprising a table including the control patterns for said first heat generating element and a table including control patterns for said second heat generating element, wherein said tables are the same.

4. The image forming apparatus according to claim 3, wherein said controller changes the phase difference within a period of the one control cycle.

5. The image forming apparatus according to claim 4, wherein the control pattern has a waveform which is a combination of a wave number control waveform and a phase control waveform.

6. The image forming apparatus according to claim 1, wherein said controller changes the phase difference in accordance with the recording material feeding speed.

7. An image forming apparatus comprising:

a fixing portion configured to fix an unfixed image formed on a recording material thereon, said fixing portion including, a first heat generating element configured to generate heat by electric power supplied from an AC power source, and a second heat generating element configured to generate heat by the electric power supplied from the AC power source, said second heat generating element being provided downstream of said first heat generating element with respect to a feeding direction of the recording material; and a controller configured to effect control comprising a plurality of control cycles to control electric power to be supplied to said first heat generating element and said second heat generating element, said controller controlling said first heat generating element and said second heat generating element independently from each other, wherein said plurality of control cycles each include a plurality of continuous half waves of AC waveforms in which control patterns are set for respective control cycles, wherein start and end points of each control cycle are zero-cross points of the AC waveform, wherein a number of continuous half waves of AC waveforms in a control cycle for said first heat generating element and a number of continuous half waves of AC waveforms in a control cycle for said second heat generating element are the same, wherein said controller sets a difference between a phase of the control cycle for said first heat generating element and a phase of the control cycle for said second heat generating element, wherein the difference is an integer multiple of a half wave of AC waveforms, and wherein the integer multiple depends on the distance between the first and second heat generating elements.

8. The image forming apparatus according to claim 7, wherein said image forming apparatus is configured to set a plurality of feeding speeds of the recording material, and said controller changes the phase difference in accordance with the recording material feeding speed.

9. The image forming apparatus according to claim 8, wherein said controller sets a control level for each one control cycle in accordance with a temperature of said fixing potion.

10. The image forming apparatus according to claim 9, further comprising a table including control patterns for said first heat generating element and a table including control patterns for said second heat generating element, wherein said tables are the same.

11. The image forming apparatus according to claim 7, wherein the phase difference is set within a period of the one control cycle.

12. The image forming apparatus according to claim 7, wherein current waveforms flowing through said first heat generating element and said second heat generating element comprises a waveform which is a combination of a wave number control waveform and a phase control waveform.

13. The image forming apparatus according to claim 7, said fixing portion further including an endless belt.

14. The image forming apparatus according to claim 13, wherein said first heat generating element and said second heat generating element are formed on a ceramic substrate.

15. The image forming apparatus according to claim 14, said ceramic substrate being contact with an inner surface of said endless belt.

* * * * *